US008162187B2

(12) United States Patent
Barbanti

(10) Patent No.: US 8,162,187 B2
(45) Date of Patent: Apr. 24, 2012

(54) APPARATUS FOR SUPPORTING TROUSERS, PARTICULARLY USABLE DURING THE FINISHING OPERATIONS IN IRONING TROUSERS

(75) Inventor: Carlo Barbanti, Mirandola (IT)

(73) Assignee: Barbanti S.r.l., Mirandola (MO) (IT)

( * ) Notice: Subject to any disclaimer, the term of this patent is extended or adjusted under 35 U.S.C. 154(b) by 389 days.

(21) Appl. No.: 12/312,153

(22) PCT Filed: Oct. 31, 2007

(86) PCT No.: PCT/IB2007/003295

§ 371 (c)(1),
(2), (4) Date: Jul. 10, 2009

(87) PCT Pub. No.: WO2008/053328

PCT Pub. Date: May 8, 2008

(65) Prior Publication Data

US 2010/0065591 A1 Mar. 18, 2010

(30) Foreign Application Priority Data

Nov. 3, 2006 (IT) ..... MO2006A0353

(51) Int. Cl.
*D06C 15/00* (2006.01)

(52) U.S. Cl. ..... 223/72

(58) Field of Classification Search ..... 223/72, 223/74, 95, 52, 37, 33, 34, 35, 1
See application file for complete search history.

(56) References Cited

U.S. PATENT DOCUMENTS

| | | | | | |
|---|---|---|---|---|---|
| 669,561 | A * | 3/1901 | Tenney | 223/95 |
| 3,255,939 | A * | 6/1966 | Buzzelli | 223/95 |
| 3,643,841 | A * | 2/1972 | Rhindress | 223/95 |
| 3,713,643 | A * | 1/1973 | Gerstenberger | 493/405 |
| 3,730,405 | A * | 5/1973 | Ezell et al. | 223/72 |
| 4,196,813 | A * | 4/1980 | Cohen | 211/168 |
| 4,401,244 | A * | 8/1983 | Selvi et al. | 223/37 |
| 5,433,355 | A * | 7/1995 | Watkins | 223/1 |
| 5,613,630 | A * | 3/1997 | Isenga et al. | 223/88 |
| 7,182,232 | B2 * | 2/2007 | Fleming et al. | 223/88 |
| 2010/0065591 | A1 * | 3/2010 | Barbanti | 223/72 |

FOREIGN PATENT DOCUMENTS

| | | |
|---|---|---|
| DE | 1185568 | 1/1965 |
| DE | 1236459 | 3/1967 |
| DE | 2094840 | 9/1982 |
| GB | 1184316 | 12/1964 |

* cited by examiner

*Primary Examiner* — Shaun R Hurley
*Assistant Examiner* — Andrew Sutton
(74) *Attorney, Agent, or Firm* — Stewart McEwen, LLP

(57) ABSTRACT

An apparatus for supporting trousers, particularly usable during the finishing operations in ironing trousers, includes a bearing structure, a fastening device on the bearing structure and to which, in one work configuration, at least one trouser support element can be connected, with the trousers having at least one end removable from the support element and extending along a substantially vertical direction, and automatic removal device for removing the support element from the trousers.

28 Claims, 3 Drawing Sheets

APPARATUS FOR SUPPORTING TROUSERS, PARTICULARLY USABLE DURING THE FINISHING OPERATIONS IN IRONING TROUSERS

TECHNICAL FIELD

The present invention relates to an apparatus for supporting trousers, particularly usable for the finishing operations in ironing trousers.

BACKGROUND ART

It is common knowledge that professional ironing machines for ironing clothes are used in the industrial laundry sector or for industrial ironing in general.

With particular reference to ironing the crease in trousers, it is also common knowledge that there is the need to finish ironing by hand, after the above mentioned machines have been used.

As a rule these finishing operations are done by an operator using an iron and with the trousers laying on a horizontal ironing surface or, alternatively, hanging from a support book and extending vertically.

This last solution is opted for particularly after using ironing machines with a vertical ironing surface.

In this case, in fact, a pair of spring clamps is associated removable to each free end of the trouser legs and is used to hang the trousers on a support of the ironing machine, during ironing, as well as to position the trousers on said hook in the next finishing phases.

These spring clamps normally have two toothed appendages, spaced from each other, which can be inserted inside the opening by the free ends of the trouser legs and which are positionable by the edge of the opening in order to grip it and keep it taut.

Once ironing is completed, the trousers are taken off the machine and hung, by means of the spring clamps, on the support hook that can either be fixed or, if wanted, manually height adjustable.

The finishing operations are carried out by the operator on the trousers placed vertically, using an iron.

The operator then removes the spring clamps from the hook, frees the trousers from the spring clamps and lastly positions the trousers on an ordinary clothes hanger.

These finishing operations do have some drawbacks such as, for example, they are particularly wasteful in terms of time and even have an effect on the overall cost of ironing that is far from negligible.

In fact, the operator has to manually adjust the height of the hook based on his/her height and on the length of the trousers to iron.

In addition, removing the spring clamps from the trousers and positioning them correctly on a hanger constitute most of the "downtime" between one ironing operation and the next.

OBJECT OF THE INVENTION

The main aim of the present invention is to provide an apparatus for supporting trousers that allows the finishing ironing operations to be done on trousers limiting inactivity times between one ironing phase and the next.

Within the scope of this technical aim, another object of this invention is to simplify such finishing operations as regards to ironing trousers.

Another object of this invention is to reduce the overall costs resulting from ironing trousers.

A further object of the invention is to cater for the previous aims with a simple structure, of relatively easy practical implementation, safe and effective to use and work, as well as having a fairly low cost.

All the objects described above are achieved with this apparatus for supporting trousers, particularly usable during the finishing operations in ironing trousers, characterised in that it comprises a bearing structure, fastening means associated to said bearing structure and to which, in one work configuration, at least one trouser support element is associable, with said trousers having at least one end associated removable to said support element and extending along a substantially vertical direction, and automatic removal means for removing said support element from said trousers.

BRIEF DESCRIPTION OF THE DRAWINGS

Further characteristics and advantages of the present invention will appear more evident from the detailed description of a preferred, but not exclusive, embodiment of an apparatus for supporting trousers, particularly usable during the finishing operations in ironing trousers, illustrated by way of non limiting example in the accompanying drawings, wherein.

EMBODIMENTS OF THE INVENTION

Figure 1:
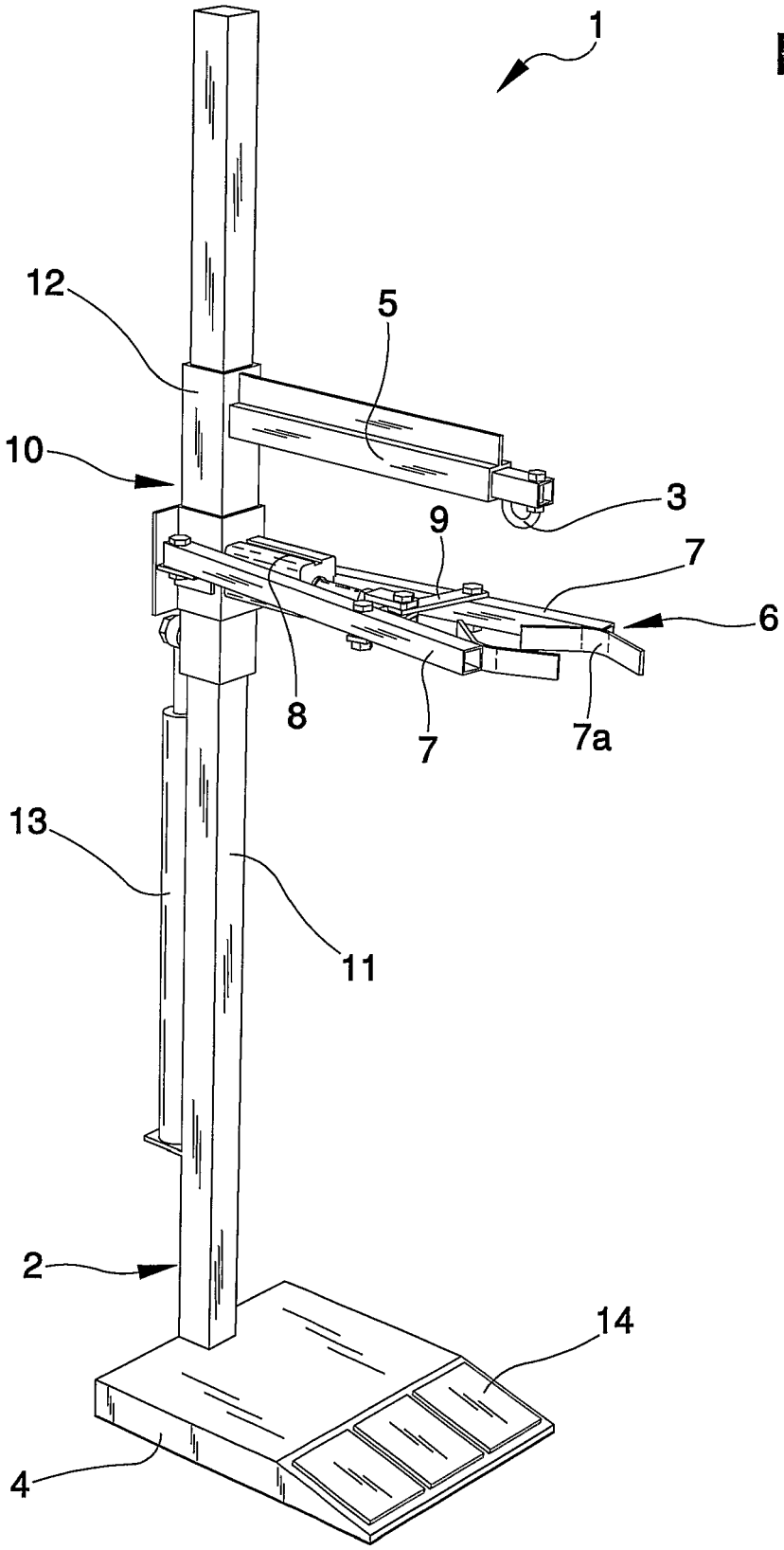
FIG. 1 is a perspective view of the apparatus according to the invention.

With special reference to such figures, the reference numeral 1 globally designates an apparatus for supporting trousers, particularly usable during the manual finishing operations in ironing trousers, after using professional ironing machines.

The apparatus 1 comprises a bearing structure 2 that supports fastening means 3 and to which, in a work configuration, at least one support element S of trousers P is associable.

In the particular embodiment of the apparatus 1 in question, the bearing structure 2 develops along a substantially vertical direction and comprises one floor standing base 4. An arm 5 extends substantially horizontally from a top portion of the bearing structure 2 and has the free end with the above mentioned fastening means 3 made up, for example, of a hook.

However, different conformations of the bearing structure 2 and/or different types or arrangements of the fastening means 3 are not excluded.

In the work configuration the support element S is hanging from the hook 3 and the trousers P have at least one end associated removable to the support element S and extend downwards along a substantially vertical direction.

More specifically, the apparatus 1 sees the use of a pair of such support elements S, made up of metal spring clamps, of the type normally used to support trousers P during conventional ironing operations performed by professional ironing machines. The spring clamps S are applied at each free end of the trouser P legs and both hang from the hook 3.

Particularly, the spring clamps S comprise one gripping section S1 associable to the hook 3, substantially curved and bending when pressed, which extends into a pair of rods S2 substantially parallel to each other. The rods S2 have ends with respective toothed appendages S3 and insertable inside the opening A by the free end of one of the trouser P legs.

Each of the spring clamps S is normally open with the rods S2 substantially distant from each other and their respective appendages S3 inserted inside one of said openings A of the trouser P legs, in contact with substantially opposite sections of the edge extended in such a way.

By pressing on the rods S2 to bring them closer together, the appendages S3 move away and disengage from the respective sections of the edge of the opening A.

Advantageously, the apparatus 1 comprises automatic removal means 6 of the spring clamps S from the trousers P.

The automatic removal means 6 are made up of a gripping body associated to the bearing structure 2, below the arm 5, which can be fastened on the rods S2 of the spring clamps S for the disengagement of the appendages S3 from the edge of the openings A of the trousers P.

Particularly, the gripping body 6 comprises a pair of small arms 7 hinged to the bearing structure 2 and turnable thanks to the action of first actuator means 8 between an open configuration, in which they are substantially distant from each other and detached from the spring clamps S, and a closed configuration, in which they are substantially brought together and engaged on sections of respective rods S2 of the spring clamps S.

Particularly, the small arms 7 are substantially horizontal and turnable around their respective substantially vertical hinged axis.

Usefully, each of the small arms 7 has the free end with a contact surface 7*a* substantially of a concave shape to define an invitation housing of the rods S2.

The first actuator means 8 are made up of a first linear actuator, of the type of a pneumatic, hydraulic or electromechanical cylinder, that has one end associated to the bearing structure 2 and the opposite end associated to the small arms 7 by interposition of a system of levers 9.

In particular, the first actuator 8 is associated to the bearing structure 2 between the hinging axes of the small arms 7 and is arranged substantially parallel to the small arms 7.

The system of levers 9 comprises a first lever and a second lever that have an end hinged at a point on the mobile portion of the first actuator 8 and binged, at the opposite end, by the substantially intermediate sections of respective small arms 7.

Hence the extension of the first actuator 8 leads to the rotation of the first and second lever, with the two small arms 7 moving away from each other. On the contrary, the retraction of the first actuator 8 leads to the rotation of the first and second lever with the small arms 7 moving closer together.

Advantageously, the bearing structure 2 comprises moving means 10 of the fastening means 3 and automatic removal means 6 along a substantially vertical moving direction. Such moving means 10 are suitable for adjusting the height of the trousers P, in the work configuration, according to parameters such as the length of the trousers P and/or the height of the operator who has to perform the ironing finishing procedure.

In particular, the bearing structure 2 comprises an upright 11 supported by the base 4 and the moving means 10 comprise a sliding carriage 12 that supports the arm 5 and the gripping body 6 and is movable along said vertical direction, on said upright 11, due to the action of second actuator means 13.

The second actuator means 13 are made up of a second linear actuator, of the type of a pneumatic, hydraulic or electro-mechanical cylinder with one end anchored to the upright 11 and the opposite end fixed to the sliding carriage 12.

Usefully, the arm 5 is suitably shaped to define at least one housing section for one or more clothes hangers G of the type conventionally used in the industrial laundry sector.

Such hangers G are generally made up of a top portion G1 that has a hook and supports a small rod G2 for supporting trousers.

Particularly, the arm 5 is substantially straight and has a shaped cross section that partly reproduces the profile of the top portion G1 of the hangers G to support. The hangers G are positioned with the top portion G1 resting on the arm 5 and with the small rod G2 suitable for supporting the trousers P placed below the area 5.

Usefully, the apparatus 1 comprises a control unit, of the type of an electronic control unit or the like, operatively connected to the first actuator 8 and to the second actuator 13.

The control unit is operatively connected to a control foot pedal 14, defined by the standing base 4 and suitable for allowing the operator to start the first actuator 8 and the second actuator 13.

When using the apparatus 1 the operator places one or more hangers G on the arm 5 to start with.

Figure 2:
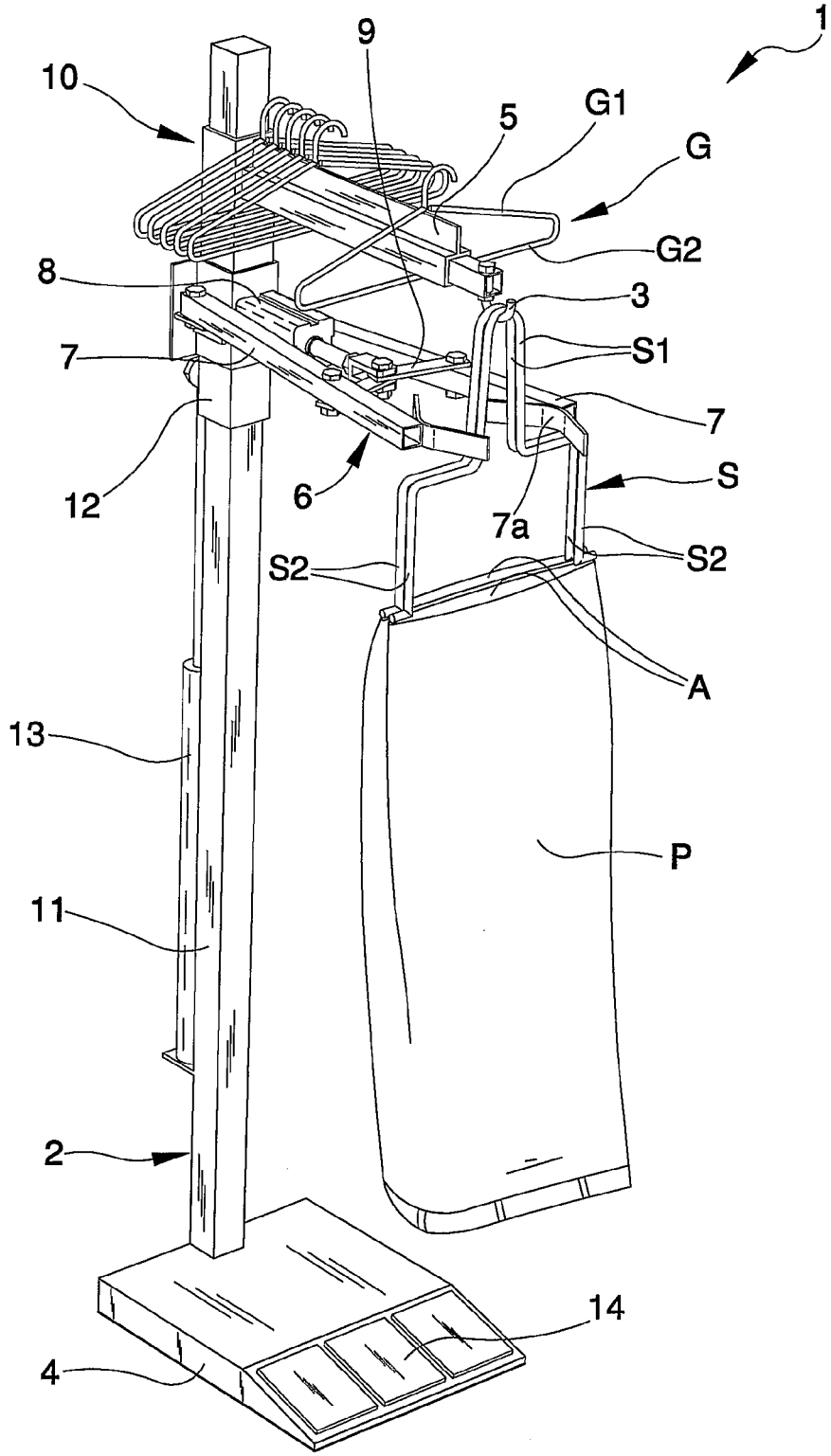
FIGS. 2, 3 and 4 are perspective views showing three subsequent phases of the use of the apparatus according to the invention.

Subsequently, the operator hangs the two spring clamps S associated to the free ends of both trouser P legs on the hook 3 (FIG. 2).

The height of the hook 3 can be adjusted if needed by the operator according to the length of the trousers P and his/her height. In fact, by means of the relative control on the foot pedal 14 the operator can start the second actuator 13 so the sliding carriage 12 can slide up or down along the upright 11.

With the trousers P hanging in this fashion, they are extending vertically and downwards and the operator can finish ironing by hand using an iron.

Figure 3:
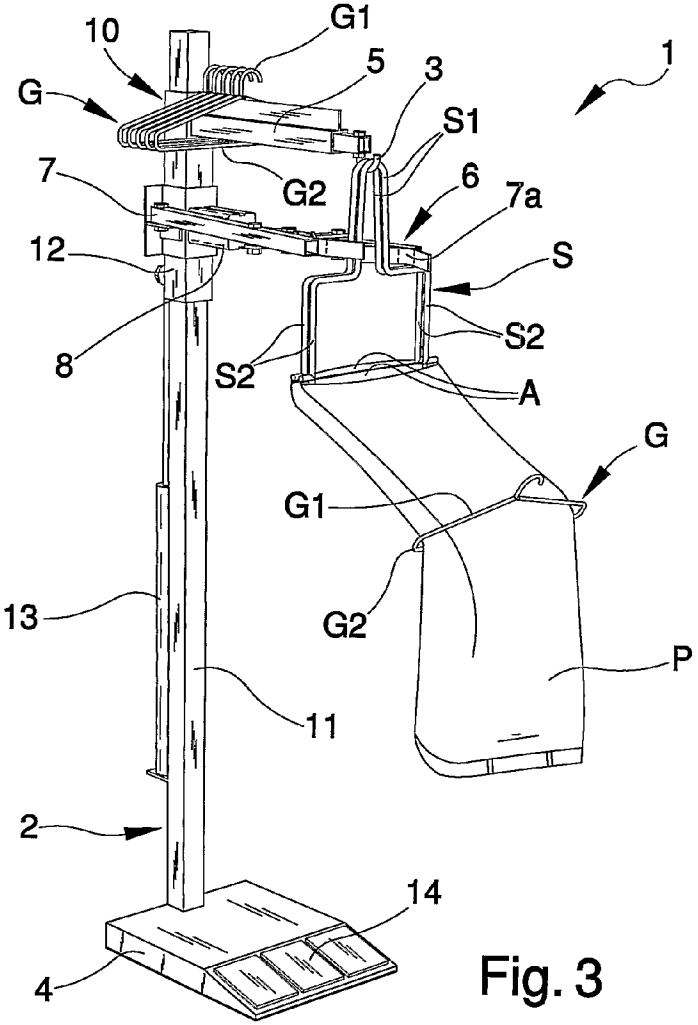

After this the operator moves one of the hangers G down from the arm 5 until its small rod G2 is by a middle section of the trousers P (FIG. 3).

Figure 4:
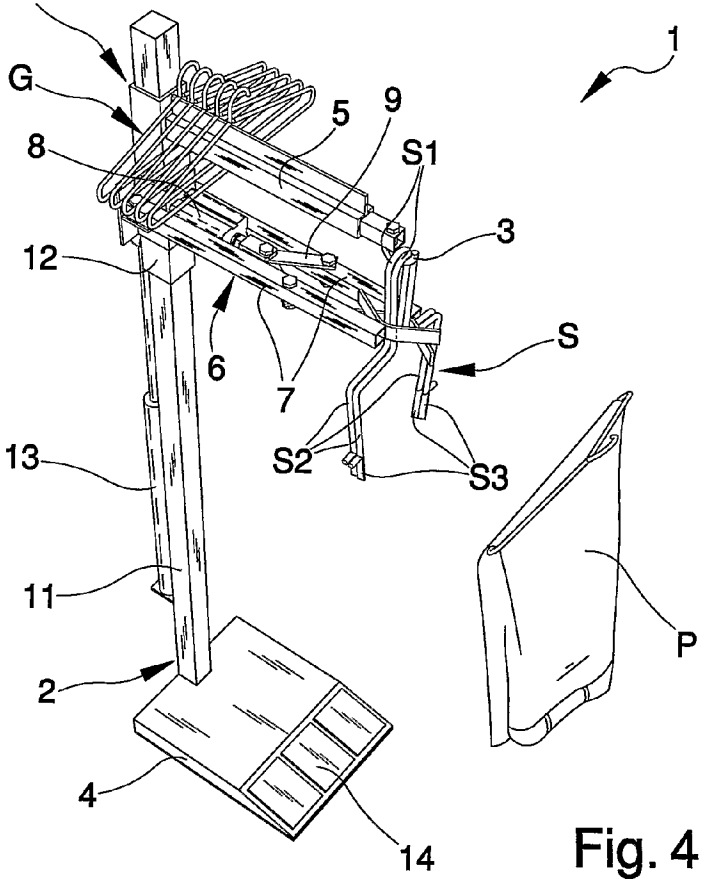

By pressing the control on the foot pedal 14, the operator starts the first actuator 8, bringing the small arms 7 into the closed configuration for the disengagement of the appendages S3 of the spring clamps S from the openings A of the trousers P (FIG. 4).

The finishing operation is now complete and the trousers P are ready to hang on the hanger G.

It was in actual fact seen how the invention described achieves the objects set and, in particular, the fact is underlined that by using the automatic removal means of the spring clamps from the trousers it is possible to speed up and streamline the phases following the manual finishing of ironing trousers with a considerable reduction in overall ironing costs.

Being able to put the hangers on the arm of the apparatus and the simplicity with which they can be positioned by the operator on the trousers results in even less downtimes between one ironing phase and the next.

Another advantage is given by the presence of the moving means of the fastening means, which simplify positioning the trousers at the right height depending on the length of the trousers and/or the height of the operator.

The invention thus conceived is susceptible to numerous modifications and variations, all of which falling within the scope of the inventive concept.

Furthermore all the details can be replaced with others that are technically equivalent.

In practice, the materials used, as well as the shapes and dimensions, may be any according to requirements without because of this moving outside the protection scope of the following claims.

The invention claimed is:

1. An apparatus for supporting trousers, particularly usable during the finishing operations in ironing trousers, comprising a bearing structure, a fastening device supported by said bearing structure and to which, in one work configuration, at least one trouser support element is mounted, said at least one support element comprising a spring clamp for a free end of at least one leg of said trousers so that said trousers will extend along a substantially vertical direction, and an automatic removal device for removing said support element from said trousers, said automatic removal device comprising at least one gripping body which can be tightened on said spring clamp.

2. The apparatus according to claim 1, wherein said gripping body is arranged below said fastening device.

3. The apparatus according to claim 1, wherein said gripping body comprises at least one pair of small arms turnably connected to said bearing structure between an open configuration in which said arms are substantially distant from each other, and a closed configuration in which said arms are substantially brought together and engaged on respective portions of said spring clamp for the disengagement of said spring clamp from said trousers.

4. The apparatus according to claim 3, wherein said small arms are turnable by a first actuator device.

5. The apparatus according to claim 4, wherein said first actuator device comprises at least a first linear actuator having one end associated to said bearing structure and the opposite end associated to at least one of said small arms.

6. The apparatus according to claim 5, wherein said first linear actuator is a pneumatic, hydraulic or electro-mechanical cylinder.

7. The apparatus according to claim 3, wherein each of said small arms has the free end having at least one contact surface with at least one portion of said spring clamp.

8. The apparatus according to claim 7, wherein said contact surface has substantially a concave shape to define an invitation housing of said portion of spring clamp.

9. The apparatus according to claim 1, wherein said bearing structure extends substantially in a vertical direction.

10. The apparatus according to claim 1, wherein said bearing structure comprises at least one floor standing base.

11. The apparatus according to claim 1, wherein said bearing structure comprises at least one substantially horizontal arm having said fastening device.

12. The apparatus according to claim 11, wherein said arm is defined close to a top portion of said bearing structure.

13. An apparatus for supporting trousers, particularly usable during finishing operations in ironing trousers, comprising:

a bearing structure, a fastening device supported by said bearing structure and to which, in one working configuration, at least one trouser support element is mounted, with said trousers having at least one end removably mounted on said support element and extending alone a substantially vertical direction, and an automatic removal device for removing said support element from said trousers, wherein said bearing structure comprises a moving arrangement of at least one between said fastening device and said automatic removal device along at least one moving direction.

14. The apparatus according claim 13, wherein said moving arrangement comprises at least one carriage sliding along said moving direction.

15. The apparatus according to claim 14, wherein said fastening device is one piece with said sliding carriage.

16. The apparatus according to claim 14, wherein said automatic removal device comprises at least one gripping body which is one piece with said sliding carriage.

17. The apparatus according to claim 14, wherein said moving arrangement comprises a second actuator device of the movement of said carriage sliding along said moving direction.

18. The apparatus according to claim 13, wherein said moving direction is substantially vertical.

19. The apparatus according to claim 1, wherein said bearing structure comprises at least one upright.

20. The apparatus according to claim 17, wherein said bearing structure comprises at least one upright and said sliding carriage is movable along said upright.

21. The apparatus according to claim 20, wherein said second actuator device comprises at least a second linear actuator associated to said upright at one end and associated with said sliding carriage at the opposite end.

22. The apparatus according to claim 20, wherein said bearing structure comprises at least one substantially horizontal arm having said fastening device, said arm being integrally associated with said sliding carriage.

23. The apparatus according to claim 20, wherein said second linear actuator is a pneumatic, hydraulic or electro-mechanical cylinder.

24. The apparatus according to claim 1, wherein said fastening device comprises at least one hook.

25. The apparatus according to claim 24, wherein said fastening device comprises at least one hook located close to a free end of said arm.

26. The apparatus according to claim 25, wherein said arm is shaped to define at least one housing section of clothes hangers.

27. The apparatus according to claim 13, comprising at least one control unit operatively connected to said automatic removal device and said moving arrangement.

28. The apparatus according to claim 27, wherein said control unit is operatively connected to at least one control foot pedal, defined by said bearing structure.

* * * * *